US011651735B2

(12) United States Patent
Chen et al.

(10) Patent No.: US 11,651,735 B2
(45) Date of Patent: May 16, 2023

(54) PIXEL CIRCUIT AND DRIVE METHOD THEREOF, AND DISPLAY PANEL

(71) Applicants: Chengdu BOE Optoelectronics Technology Co., Ltd., Chengdu (CN); BOE Technology Group Co., Ltd., Beijing (CN)

(72) Inventors: Yipeng Chen, Beijing (CN); Ling Shi, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/352,293

(22) Filed: Jun. 19, 2021

(65) Prior Publication Data

US 2022/0223107 A1 Jul. 14, 2022

(30) Foreign Application Priority Data

Jan. 12, 2021 (CN) ..... 202110038889.2

(51) Int. Cl.
*G09G 3/3258* (2016.01)
*G09G 3/3291* (2016.01)
(Continued)

(52) U.S. Cl.
CPC ..... *G09G 3/3258* (2013.01); *G09G 3/3291* (2013.01); *G09G 3/325* (2013.01);
(Continued)

(58) Field of Classification Search
CPC .... G09G 3/3258; G09G 3/325; G09G 3/3266; G09G 3/3275; G09G 3/3291; G09G 2300/0417; G09G 2320/041
See application file for complete search history.

(56) References Cited

U.S. PATENT DOCUMENTS

2015/0070252 A1 3/2015 Chen
2015/0213761 A1 7/2015 Chen
(Continued)

FOREIGN PATENT DOCUMENTS

CN 103474025 A 12/2013
CN 103474027 A 12/2013
(Continued)

OTHER PUBLICATIONS

CN202110038889.2 first office action and search report.
CN202110038889.2 Notification to Grant Patent Right for Invention.

*Primary Examiner* — William Boddie
*Assistant Examiner* — Saifeldin E Elnafia
(74) *Attorney, Agent, or Firm* — IPro, PLLC

(57) ABSTRACT

The present disclosure discloses a pixel circuit and a drive method thereof, and a display panel. The pixel circuit includes a drive transistor, a first light-emission control sub-circuit, a second light-emission control sub-circuit, a first threshold compensation sub-circuit, a second threshold compensation sub-circuit, a first initialization sub-circuit, a second initialization sub-circuit, a data-in sub-circuit, a capacitor, and a light-emitting element; wherein the second light-emission control sub-circuit is connected to the first light-emission control sub-circuit, a second initialization sub-circuit and a gate of the drive transistor, and is configured to send the signal of the first threshold compensation sub-circuit or the signal of the second threshold compensation sub-circuit to the gate of the drive transistor.

7 Claims, 4 Drawing Sheets

(51) Int. Cl.
*G09G 3/3275* (2016.01)
*G09G 3/3266* (2016.01)
*G09G 3/325* (2016.01)

(52) U.S. Cl.
CPC ..... *G09G 3/3266* (2013.01); *G09G 3/3275* (2013.01); *G09G 2300/0417* (2013.01); *G09G 2320/041* (2013.01); *G09G 2320/045* (2013.01)

(56) References Cited

U.S. PATENT DOCUMENTS

| | | | | |
|---|---|---|---|---|
| 2016/0225318 | A1* | 8/2016 | Choi | G09G 3/3258 |
| 2018/0166025 | A1* | 6/2018 | Zhou | G09G 3/3208 |
| 2018/0357964 | A1 | 12/2018 | Shin et al. | |
| 2019/0096322 | A1* | 3/2019 | Gao | G09G 3/3275 |
| 2020/0395429 | A1* | 12/2020 | Cho | H01L 51/56 |
| 2021/0118368 | A1* | 4/2021 | In | G09G 3/3258 |
| 2021/0264862 | A1* | 8/2021 | Wang | G09G 3/3233 |
| 2021/0366386 | A1 | 11/2021 | Gao | |
| 2022/0157239 | A1 | 5/2022 | Zhang et al. | |

FOREIGN PATENT DOCUMENTS

| | | | |
|---|---|---|---|
| CN | 107767819 | A | 3/2018 |
| CN | 109801592 | A | 5/2019 |
| CN | 110021273 | A | 7/2019 |
| CN | 111179854 | A | 5/2020 |
| CN | 111754920 | A | 10/2020 |
| CN | 112086071 | A | 12/2020 |

* cited by examiner

PIXEL CIRCUIT AND DRIVE METHOD THEREOF, AND DISPLAY PANEL

CROSS REFERENCE

The application claims priority to Chinese Patent Application No. 202110038889.2, titled "PIXEL CIRCUIT AND DRIVE METHOD THEREOF, AND DISPLAY PANEL" and filed on Jan. 12, 2021, the entire contents of which are incorporated herein by reference.

TECHNICAL FIELD

The present disclosure generally relates to the field of display technologies, and more particularly, to a pixel circuit and a drive method thereof, and a display panel.

BACKGROUND

Low Temperature Poly-Oxide (LTPO) technology is a low-power Organic Light-Emitting Diode (OLED) display technology. LTPO Low Temperature Poly-Oxide (TFT) has a lower driving power than LTPS TFT (Low Temperature Poly-Silicon TFT). LTPS needs a frequency 60 Hz to display stationary images, but LTPO can reduce this frequency to 1 Hz, and thus the driving power is greatly reduced. Display power consumption is classified into a driving power and a light emission power. The LTPO converts a part of transistors into oxides, with less leakage current, and can hold a capacitor voltage (electric charge) for one second to drive at 1 Hz. The LTPS has larger leakage current, and even needs 60 Hz for driving a stationary pixel.

The LTPO is originally applied to smart watches. Efficiency of the LTPO has been clearly proved in the smart watches. The light emission power of the LTPO is lower because a black area on its screen is wider. In the LTPS, ratio of the driving power to the light emission power is about 6:4. The LTPO can reduce the existing driving power to one third, such that the overall power consumption can be reduced by 40%.

SUMMARY

The present disclosure discloses a pixel circuit, a drive method thereof, and a display panel.

In a first aspect, the present disclosure provides a pixel circuit, which includes:

a light-emitting element;

a drive transistor, wherein the drive transistor is configured to generate a drive current on a conduction path from a first electrode of the drive transistor to a second electrode of the drive transistor in response to a signal from a gate of the drive transistor;

a first light-emission control sub-circuit, wherein the first light-emission control sub-circuit is connected to a first power terminal and a first electrode of the drive transistor, and is configured to apply a voltage of the first power terminal to the drive transistor in response to a light emission signal;

a second light-emission control sub-circuit, wherein the second light-emission control sub-circuit is connected to the second electrode of the drive transistor and a first terminal of the light-emitting element, and is configured to apply the drive current to the light-emitting element in response to the light emission signal, wherein a second terminal of the light-emitting element is connected to a second power terminal;

a data-in sub-circuit, wherein the data-in sub-circuit is configured to write a data signal into the first electrode of the drive transistor in response to a first switch control signal;

a first initialization sub-circuit, wherein the first initialization sub-circuit is connected to the first terminal of the light-emitting element and an initial voltage terminal, and is configured to apply a reset voltage to the light-emitting element in response to a second switch control signal;

a second initialization sub-circuit and a second threshold compensation sub-circuit, wherein the second initialization sub-circuit is connected to the second threshold compensation sub-circuit and the initial voltage terminal, and is configured to apply the reset voltage to the gate of the drive transistor in response to a third switch control signal;

a first threshold compensation sub-circuit, wherein the first threshold compensation sub-circuit is connected to the second electrode of the drive transistor and the second threshold compensation sub-circuit, and is configured to transmit a signal from the second electrode of the drive transistor to the second threshold compensation sub-circuit in response to a fourth switch control signal;

the second threshold compensation sub-circuit is connected to the first threshold compensation sub-circuit, the second initialization sub-circuit and the gate of the drive transistor, and is configured to transmit a signal from the first threshold compensation sub-circuit or a signal from the second initialization sub-circuit to the gate of the drive transistor in response to a fifth switch control signal; and a capacitor, wherein a first terminal of the capacitor is connected to the first power terminal, and a second terminal of the capacitor is connected to the gate of the drive transistor.

Optionally, the first light-emission control sub-circuit includes a first transistor. A first electrode of the first transistor is connected to the first power terminal, a second electrode of the first transistor is connected to the first electrode of the drive transistor, and a gate of the first transistor is connected to a light-emission control line configured to provide the light emission signal.

Optionally, the second light-emission control sub-circuit includes a second transistor. A first electrode of the second transistor is connected to the second electrode of the drive transistor, a second electrode of the second transistor is connected to the first terminal of the light-emitting element, and a gate of the second transistor is connected to the light-emission control line.

Optionally, the data-in sub-circuit includes a third transistor. A first electrode of the third transistor is connected to the first electrode of the drive transistor, a second electrode of the third transistor is connected to a data line, and a gate of the third transistor is connected to a first control line configured to provide the first switch control signal.

Optionally, the first initialization sub-circuit includes a fourth transistor. A first electrode of the fourth transistor is connected to the first terminal of the light-emitting element, a second electrode of the fourth transistor is connected to the initial voltage terminal, and a gate of the fourth transistor is connected to a second control line configured to provide the second switch control signal.

Optionally, the second initialization sub-circuit includes a fifth transistor, the first threshold compensation sub-circuit includes a sixth transistor, and the second threshold compensation sub-circuit includes a seventh transistor, a first electrode of the sixth transistor is connected to the second electrode of the drive transistor, a second electrode of the sixth transistor is connected to a first electrode of the fifth transistor and a second electrode of the seventh transistor, a first electrode of the seventh transistor is connected to the gate of the drive transistor, and a second electrode of the fifth transistor is connected to the initial voltage terminal;

a gate of the fifth transistor is connected to a third control line configured to provide the third switch control signal. A gate of the sixth transistor is connected to a fourth control line configured to provide the fourth switch control signal, and a gate of the seventh transistor is connected to a fifth control line configured to provide the fifth switch control signal.

Optionally, the first control line and the second control line are the same signal line, and the first switch control signal and the second switch control signal are the same switch control signal.

Optionally, one of the third transistor and the fourth transistor is an N-type transistor, and the other one is a P-type transistor.

Optionally, the first control line and the second control line are different signal lines, and the first switch control signal and the second switch control signal are different switch control signals.

Optionally, the third transistor and the fourth transistor are N-type transistors.

Optionally, the fifth transistor and the sixth transistor are oxide thin-film transistors. The drive transistor, the first transistor, the second transistor, the third transistor, the fourth transistor and the seventh transistor are low temperature poly-oxide thin-film transistors.

In a second aspect, the present disclosure provides a method for driving a pixel circuit. Applied to the above pixel driving circuit, the driving method includes a reset phase, a threshold compensation phase, and a light enable phase.

In the reset phase, the first initialization sub-circuit applies the reset voltage to the light-emitting element in response to the second switch control signal to reset the first terminal of the light-emitting element. The second initialization sub-circuit controls on/off of the second initialization sub-circuit in response to the third switch control signal. The second threshold compensation sub-circuit controls on/off of the second threshold compensation sub-circuit in response to the fifth switch control signal, and applies the reset voltage to the gate of the drive transistor to reset the gate of the drive transistor.

In the threshold compensation phase, the data-in sub-circuit writes a data signal to the first electrode of the drive transistor in response to the first switch control signal, the data signal is inputted to a data voltage Vdata, and a voltage of the first electrode of the drive transistor is charged to Vdata, such that the drive transistor is enabled. The first threshold compensation sub-circuit and the second threshold compensation sub-circuit control, respectively in response to the fourth switch control signal and the fifth switch control signal, to enable a circuit between the second electrode and the gate of the drive transistor, such that a voltage at the gate of the drive transistor is Vdata+Vth, wherein Vth represents a threshold voltage corresponding to the drive transistor, to compensate for the voltage of the gate of the drive transistor.

In the light enable phase, the first light-emission control sub-circuit applies the voltage of the first power terminal to the first electrode of the drive transistor in response to the light emission signal, such that the drive transistor is enabled, and the second light-emission control sub-circuit applies the drive current to the light-emitting element in response to the light emission signal to drive the light-emitting element to emit light.

Further, the method further includes:

before the threshold compensation phase ends, the fifth switch control signal controls the second threshold compensation sub-circuit to be disabled certain time ahead of the first threshold compensation sub-circuit, and controls the circuit between the gate and the second electrode of the drive transistor to be disabled within the time period.

Optionally, the method further includes:

under the condition that the pixel circuit is configured to drive a full black screen, a first preset amount of active pulse signals are loaded to the second switch control signal, such that the first initialization sub-circuit is controlled to be enabled or disabled by means of the second switch control signal, to reset the first terminal of light-emitting element multiple times.

Optionally, the light enable phase also includes a second preset amount of reset subphases and a light enable subphase after each of the reset subphases.

Optionally, in the light enable phase, the second switch control signal and the light emission signal have the same pulse frequency.

Optionally, the second light-emission control sub-circuit includes a second transistor, the first initialized sub-circuit includes a fourth transistor;

In the reset phase, the fourth transistor is an N-type low-temperature polycrystalline oxide thin film transistor, the second transistor is a P-type low-temperature polycrystalline oxide thin film transistor, the reset voltage is applied to the light-emitting element through the fourth transistor to reset the first end of the light-emitting element.

Optionally, the first control line and the second control line are different signal lines, and the first switch control signal and the second switch control signal are different switch control signals.

In a third aspect, the present disclosure provides a display panel, which includes the aforementioned pixel circuit.

The above description is merely a summary of the technical solutions of the present disclosure. In order to more clearly know the elements of the present disclosure to enable the implementation according to the contents of the description, and in order to make the above and other purposes, features and advantages of the present disclosure more apparent and understandable, the particular embodiments of the present disclosure are provided below.

BRIEF DESCRIPTION OF THE DRAWINGS

For clearer descriptions of the technical solutions in the embodiments of the present disclosure, the following briefly introduces the accompanying drawings required for describing the embodiments of the present disclosure. Apparently, the accompanying drawings in the following description show merely some embodiments of the present disclosure, and a person of ordinary skill in the art may still derive other drawings from these accompanying drawings without creative efforts.

Other features, objectives and advantages of the present disclosure will become more apparent upon reading the detailed description to non-limiting embodiments with reference to the accompanying drawings, wherein.

DETAILED DESCRIPTION

The present disclosure will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the invention are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

In the related technologies, a pixel circuit generally is composed of eight thin-film transistors and one capacitor (8TFT1C), and one TFT is arranged between a second electrode and a gate of a drive transistor to serve as a threshold compensation unit. However, a gate switch control signal of a threshold compensation TFT may jump downwards at the end of a compensation phase, and a parasitic capacitor Cgs of the threshold compensation TFT may drive a gate voltage of the drive transistor to jump upwards, which results in a reduced charge rate of the drive transistor and a worse compensation effect. Furthermore, a data range L0~L255 may be caused to deviate to a positive voltage direction as a whole. As a result, integrated circuits (IC) of a part of drive transistors may be unable to support a larger positive voltage output.

Figure 1:
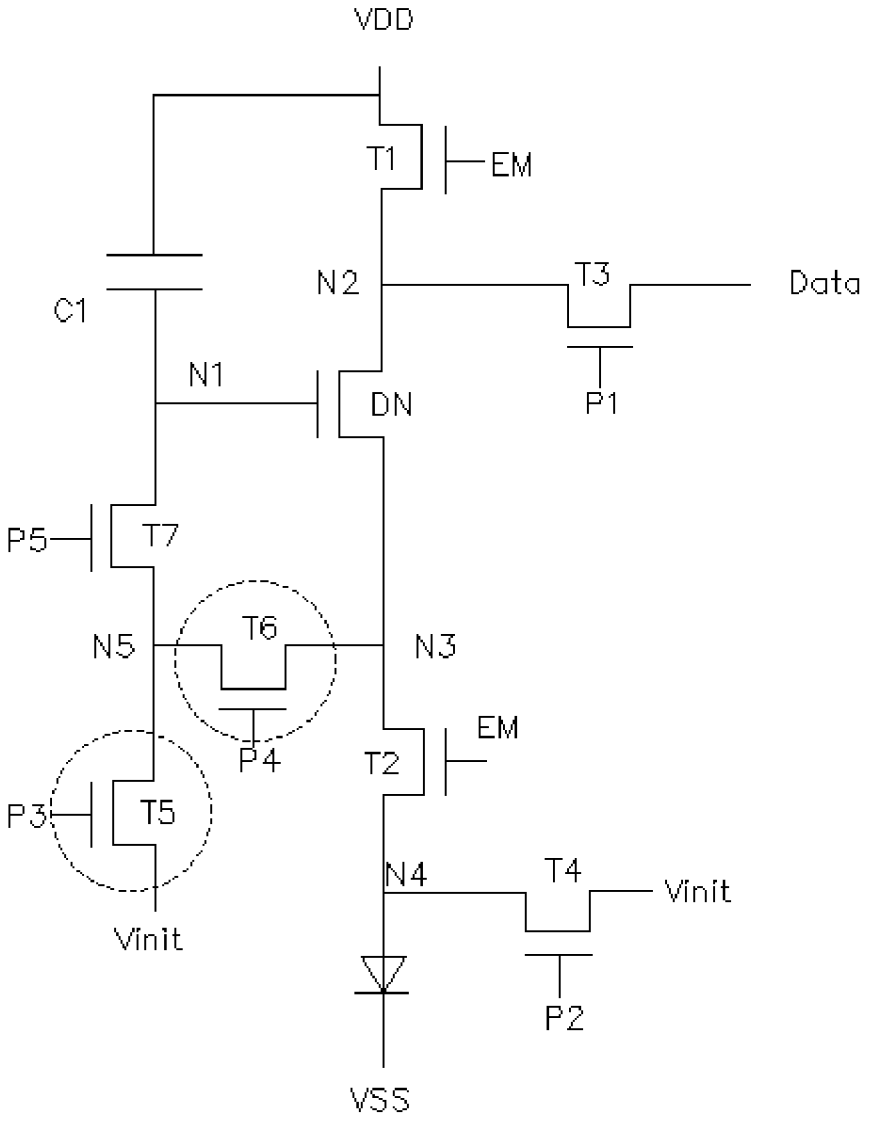
FIG. 1 is a schematic diagram of a pixel circuit according to an embodiment of the present disclosure.

Referring to FIG. 1, the present disclosure provides a pixel circuit, which includes a drive transistor DN, a first light-emission control sub-circuit, a second light-emission control sub-circuit, a first threshold compensation sub-circuit, a second threshold compensation sub-circuit, a first initialization sub-circuit, a second initialization sub-circuit, a data-in sub-circuit, a capacitor C, and a light-emitting element.

The drive transistor DN is configured to generate a drive current on a conduction path from a first electrode of the drive transistor DN to a second electrode of the drive transistor DN in response to a signal from a gate of the drive transistor DN.

The first light-emission control sub-circuit is connected to a first power terminal and the second electrode of the drive transistor DN, and is configured to apply a voltage of the first power terminal to the drive transistor DN in response to a light emission signal EM.

The second light-emission control sub-circuit is connected to the second electrode of the drive transistor DN and a first terminal of the light-emitting element, and is configured to apply the drive current to the light-emitting element in response to the light emission signal EM, wherein a second terminal of the light-emitting element is connected to a second power terminal.

The data-in sub-circuit is configured to write a data signal into a first electrode of the drive transistor DN in response to a first switch control signal P1.

The first initialization sub-circuit is connected to the first terminal of the light-emitting element and an initial voltage terminal, and is configured to apply a reset voltage to the light-emitting element in response to a second switch control signal P2.

The second initialization sub-circuit is connected to the second threshold compensation sub-circuit and the initialization voltage terminal, and is configured to apply the reset voltage to the gate of the drive transistor DN in response to a third switch control signal P3.

The first threshold compensation sub-circuit is connected to the second electrode of the drive transistor DN and the second threshold compensation sub-circuit, and is configured to transmit a signal from the second electrode of the drive transistor DN to the second threshold compensation sub-circuit in response to a fourth switch control signal P4.

The second threshold compensation sub-circuit is connected to the first threshold compensation sub-circuit, the second initialization sub-circuit and the gate of the drive transistor DN, and is configured to transmit a signal from the first threshold compensation sub-circuit or a signal from the second initialization sub-circuit to the gate of the drive transistor DN in response to a fifth switch control signal P5.

A first terminal of the capacitor C is connected to the first power terminal, and a second terminal of the capacitor C is connected to the gate of the drive transistor DN.

The light-emitting element may be a current-driven light-emitting device including a light-emitting diode (LED) or an organic light-emitting diode (OLED) in the related technologies. In the following embodiments, reference is made by taking the OLED as an example. It is to be noted that the light-emitting element may be various types of OLED, such as top-emission, bottom-emission, and double-side emission, etc. The light-emitting element can emit red light, green light, blue light, or white light, but the embodiments of the present disclosure are not limited thereto.

The transistors may be separately selected from one of polysilicon thin-film transistors, amorphous-silicon thin-film transistors, oxide thin-film transistors, and organic thin-film transistors. A "control electrode" specifically refers to the gate of the transistor, the "first electrode" specifically refers to the source of the transistor, and the "second electrode" specifically refers to the drain of the transistor. Of course, those skilled in the art should know that the "first electrode" and the "second electrode" are interchangeable. That is, the "first electrode" specifically refers to the drain of the transistor, and the "second electrode" specifically refers to the source of the transistor.

In addition, the transistors may be classified into N-type transistors and P-type transistors based on different semiconductor characteristics of the transistors. When the transistor is used as a switching transistor, the N-type switching transistor is enabled under control of a high-level switch control signal, and is disabled under control of a low-level switch control signal. The P-type switching transistor is enabled under control of the low-level switch control signal, and is disabled under control of the high-level switch control signal.

A pixel circuit includes a drive transistor DN, a first light-emission control sub-circuit, a second light-emission control sub-circuit, a first threshold compensation sub-circuit, a second threshold compensation sub-circuit, a first initialization sub-circuit, a second initialization sub-circuit, a data-in sub-circuit, a capacitor, and a light-emitting element.

The first light-emission control sub-circuit includes a first transistor T1. A first electrode of the first transistor T1 is connected to the first power terminal, a second electrode of the first transistor T1 is connected to the first electrode of the drive transistor DN, and a gate of the first transistor T1 is connected to a light-emission control line configured to provide the light emission signal EM.

The second light-emission control sub-circuit includes a second transistor T2. A first electrode of the second transistor T2 is connected to the second electrode of the drive transistor DN, a second electrode of the second transistor T2 is connected to the first terminal of the light-emitting element, and a gate of the second transistor T2 is connected to the light-emission control line.

The data-in sub-circuit includes a third transistor T3. A first electrode of the third transistor T3 is connected to the first electrode of the drive transistor DN, a second electrode of the third transistor T3 is connected to a data line, and a gate of the third transistor T3 is connected to a first control line configured to provide the first switch control signal P1.

The first initialization sub-circuit includes a fourth transistor T4. A first electrode of the fourth transistor T4 is connected to the first terminal of the light-emitting element, a second electrode of the fourth transistor T4 is connected to the initial voltage terminal, and a gate of the fourth transistor T4 is connected to a second control line configured to provide the second switch control signal P2.

The second initialization sub-circuit includes a fifth transistor T5, the first threshold compensation sub-circuit includes a sixth transistor T6, and the second threshold compensation sub-circuit includes a seventh transistor T7.

A first electrode of the sixth transistor T6 is connected to the second electrode of the drive transistor DN, a second electrode of the sixth transistor T6 is connected to a first electrode of the fifth transistor T5 and a second electrode of the seventh transistor T7, a first electrode of the seventh transistor T7 is connected to the gate of the drive transistor DN, and a second electrode of the fifth transistor T5 is connected to the initial voltage terminal.

A gate of the fifth transistor T5 is connected to a third control line configured to provide the third switch control signal P3. A gate of the sixth transistor T6 is connected to a fourth control line configured to provide the fourth switch control signal P4, and a gate of the seventh transistor T7 is connected to a fifth control line configured to provide the fifth switch control signal P5.

It is to be noted that if the first power terminal VDD in this embodiment of the present disclosure keeps inputting a DC high level signal, this DC high level is referred to as a first voltage. If the first power terminal VDD keeps inputting a DC low level signal, this DC low level is referred to as a second voltage, wherein the second voltage is lower than the first voltage. The following embodiments are the same as this embodiment, and thus are not to be repeated any more.

In some embodiments, the first control line and the second control line are the same signal line, and the first switch control signal P1 and the second switch control signal P2 are the same switch control signal. Correspondingly, one of the third transistor T3 and the fourth transistor T4 is an N-type transistor, and the other one is a P-type transistor.

When the first switch control signal P1 and the second switch control signal P2 are the same signal, the switch control signal of the pixel circuit may be simplified, and wiring space can be saved. In specific settings, the third transistor T3 controlled by the first switch control signal P1 is configured to perform threshold compensation and data writing on a driving circuit in the threshold compensation phase. The fourth transistor T4 controlled by the second switch control signal P2 is configured to reset the first terminal of the light-emitting element in the reset phase. That is, the third transistor T3 and the fourth transistor T4 are respectively configured to control active signals in different phases. Therefore, the transistors corresponding to the control lines are transistors of opposite types, such that when the high level or low level is inputted in the same phase, one of the transistors is enabled, but the other transistor is disabled.

In some other embodiments, the first control line and the second control line are different signal lines, and the first switch control signal P1 and the second switch control signal P2 are different switch control signals.

When the first switch control signal P1 and the second switch control signal P2 are different signals, two transistors respectively corresponding to the first switch control signal P1 and the second switch control signal P2 may be of the same type. Corresponding active signals are set at different phases, and the corresponding transistors are controlled to be enabled to implement corresponding functions. For example, the third transistor T3 and the fourth transistor T4 are both the N-type transistors, and the third transistor T3 is controlled to be enabled by controlling the first switch control signal P1 to be at a high level in the threshold compensation phase. At this moment, the second switch control signal P2 is at a low level, and the fourth transistor T4 is controlled to be disabled. In the reset phase, the second switch control signal P2 is at the high level, and the fourth transistor T4 is controlled to be enabled. At this moment, the first switch control signal P1 may be at the high level or the low level, which has no effect on the reset phase.

In some embodiments, the fifth transistor T5 and the sixth transistor T6 are oxide thin-film transistors. The drive transistor DN, the first transistor T1, the second transistor T2, the third transistor T3, the fourth transistor T4 and the seventh transistor T7 are low temperature poly-oxide thin-film transistors.

In the oxide thin-film transistor (oxide TFT), for example, an oxide semiconductor such as indium gallium zinc oxide (IGZO) is used as an active layer of the TFT. The oxide semiconductor has a higher electron mobility and better turn-off characteristic. Compared with low temperature poly silicon (LTPS), the oxide semiconductor is simpler in fabrication process and has higher compatibility with an amorphous silicon fabrication process. Of course, the oxide TFT may also be other metal oxide semiconductors, such as indium zinc tin oxide (IZTO) or indium gallium zinc tin oxide (IGZTO). The use of the oxide TFT can effectively reduce a size of the transistor and prevent leakage current, thereby ensuring that the pixel circuit may be suitable for low-frequency driving, and the resolution of the display panel can also be increased.

The low temperature poly-oxide thin-film transistor (LTPO TFT) has a lower driving power than the LTPS TFT. Compared with the LTPS display panel, the LTPO display panel has higher resolution, higher response speed, higher brightness, higher aperture ratio, lower fabrication cost, and lower power consumption.

To reduce the power consumption of the OLED, the pixel circuit may be driven by a low-frequency signal. However, if all the transistors in the pixel circuit are P-type transistors, because the P-type transistors have larger leakage current, phenomena such as flicker may occur when low-frequency driving is used, which limits the utilization of the pixel circuit. In this embodiment of the present disclosure, the pixel circuit is a pixel circuit where the N-type transistors and the P-type transistors are used in combination, which can overcome the phenomenon of flicker when the pixel circuit is used for low-frequency driving. Furthermore, the N-type transistors have smaller leakage current, thus there is no need to consider the aging problem of the N-type transistors.

Figure 2:
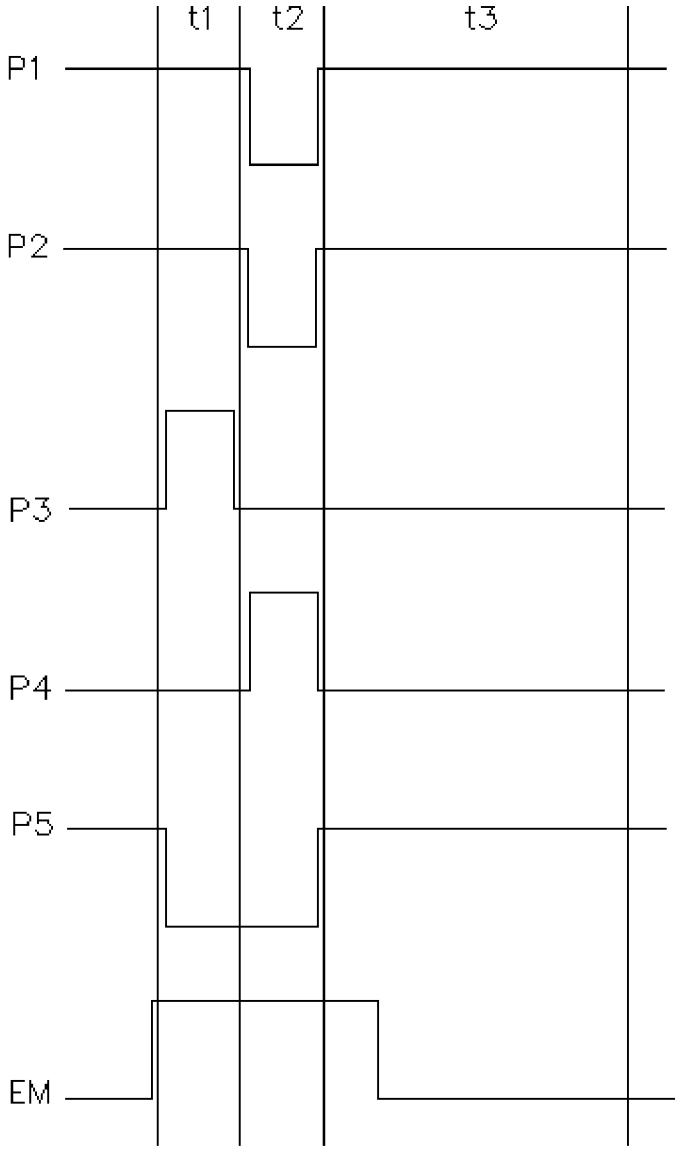
FIG. 2 is a timing diagram of a pixel circuit according to an embodiment of the present disclosure.

The present disclosure provides a method for driving a pixel circuit. Applied to the above pixel driving circuit, the driving method includes a reset phase, a threshold compensation phase, and a light enable phase, as shown in FIG. 2.

In the reset phase t1, the first initialization sub-circuit applies the reset voltage to the light-emitting element in response to the second switch control signal P2 to reset the first terminal of the light-emitting element. The second initialization sub-circuit controls on/off of the second initialization sub-circuit in response to the third switch control signal P3. The second threshold compensation sub-circuit controls on/off of the second threshold compensation sub-circuit in response to the fifth switch control signal P5, and applies the reset voltage to the gate of the drive transistor DN to reset the gate of the drive transistor DN.

In addition, it is defined that the gate of the drive transistor DN and the second threshold compensation sub-circuit are connected at a first node N1, the first electrode of the drive transistor DN and the first light-emission control sub-circuit are connected at a second node N2, the second electrode of the drive transistor DN is connected to the second light-emission control sub-circuit and the first threshold compensation sub-circuit at a third node N3, the first initialization sub-circuit and the first terminal of the light-emitting element are connected at a fourth node N4, and the first threshold compensation sub-circuit is connected to the second threshold compensation sub-circuit and the second initialization sub-circuit at a fifth node N5.

It is to be noted that in the description of the embodiments of the present disclosure, the first node N1, the second node N2, the third node N3, the fourth node N4 and the fifth node N5 do not represent components that actually exist, but rather represent junctions for connection of related circuits in the circuit diagrams.

In this embodiment of the present disclosure, the first control line and the second control line are the same signal line, and the first switch control signal P1 and the second switch control signal P2 are the same switch control signal.

As an N-type LTPO TFT, the fourth transistor T4 is enabled when the second switch control signal P2 is at a high level. As a P-type LTPO TFT, the second transistor T2 is disabled when the light emission signal EM is at the high level. The reset voltage is applied to the light-emitting element by means of the fourth transistor T4 to reset the first terminal of the light-emitting element. As an N-type TFT, the fifth transistor T5 is enabled when the third switch control signal P3 is at the high level. As a P-type LTPO TFT, the seventh transistor T7 is enabled when the fifth switch control signal P5 is at a low level. As an N-type TFT, the sixth transistor T6 is disabled when the fourth switch control signal P4 is at the low level. As a P-type LTPO TFT, the third transistor T3 is disabled when the first switch control signal P1 is at the high level. The reset voltage is applied to the gate of the drive transistor DN by means of the fifth transistor T5 and the seventh transistor T7 to reset the gate of the drive transistor DN.

In the reset phase t1, a voltage at the first node N1 is Vinit, the voltage at the fourth node N4 is Vinit, and the voltage at the fifth node N5 is Vinit. At this moment, two terminals of the second node N2 and two terminals of the third node N3 are in an off state, the voltage at the gate is Vinit, and as the N-type LTPO TFT, the drive transistor DN is in a disabled state at the low level. Voltages of nodes in different phases are as shown in the table below.

| | reset phase t1 | compensation phase t2 | light enable phase t3 |
|---|---|---|---|
| N1 | Vinit | Vdata + Vth | Vdata + Vth |
| N2 | — | Vdata | VDD |
| N3 | — | Vdata + Vth | Vanode |
| N4 | Vinit | Vinit | Vanode |
| N5 | Vinit | Vdata + Vth | — |

In the threshold compensation phase t2, the data-in sub-circuit writes a data signal to the first electrode of the drive transistor DN in response to the first switch control signal P1, the data signal is inputted to a data voltage Vdata, and a voltage of the first electrode of the drive transistor DN is charged to Vdata, such that the drive transistor DN is enabled. The first threshold compensation sub-circuit and the second threshold compensation sub-circuit control, respectively in response to the fourth switch control signal P4 and the fifth switch control signal P5, to enable a circuit between the second electrode and the gate of the drive transistor DN, such that a voltage at the gate of the drive transistor DN is Vdata+Vth, wherein Vth represents a threshold voltage corresponding to the drive transistor DN. In this way, the voltage of the gate of the drive transistor DN is compensated for.

In the phase t2, as a P-type LTPO TFT, the third transistor T3 is enabled when the first switch control signal P1 is at the low level. The drive transistor DN is in the disabled state, and the data voltage Vdata is applied to the first electrode of the drive transistor DN by means of the third transistor T3. When the voltage of the first electrode of the drive transistor DN is charged to Vdata, the voltage at the gate of the drive transistor DN is Vinit, and the drive transistor DN is enabled at the high level. The first electrode of the drive transistor DN is further charged, and at this moment the voltage of the third node N3 is Vdata+Vth, wherein Vth represents a threshold voltage corresponding to the drive transistor DN. As an N-type TFT, the sixth transistor T6 is enabled when the fourth switch control signal P4 is at the high level. As a P-type LTPO TFT, the seventh transistor T7 is enabled when the fifth switch control signal P5 is at the low level. At this moment, the voltage of the first node N1 is Vdata+Vth. In this way, the voltage at the gate of the drive transistor DN is compensated for, and the data signal is written into the capacitor C.

It is also to be noted that in this phase, the light emission signal EM is at the high level, and the first transistor T1 and the second transistor T2 are disabled at the high level. The third switch control signal P3 is at the low level, and the fifth transistor T5 is disabled at the low level. The second switch control signal P2 is at the low level, and the fourth transistor T4 is disabled at the low level. Of course, the fourth transistor T4 also may be enabled or disabled in response to other signals, which has no effect on subsequent light enable phase of the pixel circuit. The embodiments of the present disclosure are not limited thereto.

In the light enable phase t3, the first light-emission control sub-circuit applies the voltage of the first power terminal to the first electrode of the drive transistor DN in response to the light emission signal EM, such that the drive transistor DN is enabled. The second light-emission control sub-circuit applies the drive current to the light-emitting element in response to the light emission signal EM to drive the light-emitting element to emit light.

In this phase t3, the light emission signal EM is at the low level, the first transistor T1 and the second transistor T2 are enabled at the low level, and the drive transistor DN is enabled. Other transistors are all disabled under the control of the corresponding switch control signals.

In the light enable phase t3, the drive transistor DN runs in a saturated state. According to current characteristics in the saturated state, a saturation current I flowing through the drive transistor DN and driving the light-emitting element to emit light satisfies the following formula:

$$\begin{aligned} I &= 1/2 * \mu * Cox * W/L * (Vgs - Vth)^2 \\ &= K(Vdata + Vth - VDD - Vth)^2 \\ &= K(Vdata - VDD)^2 \end{aligned}$$

wherein K represents a structural parameter, and this value is relatively stable in the same structure and thus may be regarded as a constant. As can be seen, an operating current of the light-emitting element is no longer affected by the threshold voltage Vth of the drive transistor DN, which thoroughly solves drift of the threshold voltage Vth of the drive transistor DN caused by the fabrication process and long-term operation, thereby improving nonuniformity of panel display.

Figure 3:
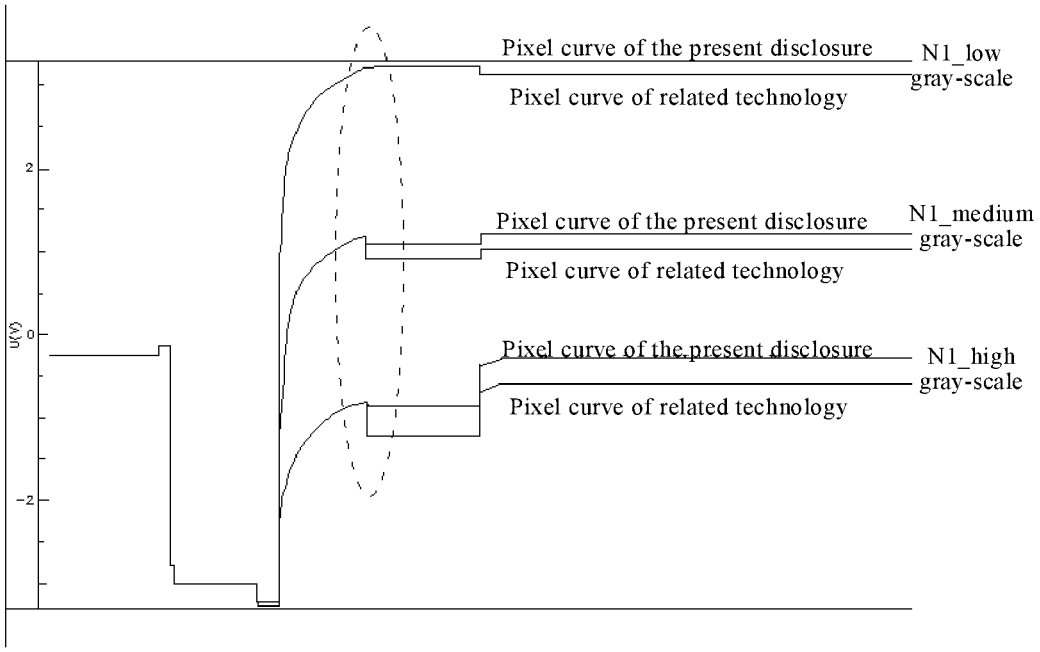
FIG. 3 illustrates contrast curves between a node N1 in a related pixel circuit and a pixel circuit according to an embodiment of the present disclosure.

According to the technical solution in this embodiment, before the light enable phase and at the end of the voltage compensation phase, the fourth switch control signal P4 jumps downwards such that the sixth transistor T6 is disabled, and the fifth switch control signal P5 jumps upwards such that the seventh transistor T7 is disabled. In this embodiment of the present disclosure, a low temperature poly-silicon thin-film transistor (LTPS TFT) serves as the seventh transistor T7. When the gate voltage jumps upwards, the parasitic capacitor Cgs drives the first node N1 to jump upwards, which compensates for effects of the gate of the sixth transistor T6 jumping downwards on the first node N1. In this way, it can be implemented that the data range L0~L255 deviates to the direction of the voltage 0V as a whole, as shown in FIG. 3.

A method for driving a pixel circuit is applied to the aforementioned pixel driving circuit. The driving method includes a reset phase, a threshold compensation phase, and a light enable phase.

In the threshold compensation phase t2, the data-in sub-circuit writes a data signal to the first electrode of the drive transistor DN in response to the first switch control signal P1, the data signal is inputted to a data voltage Vdata, and a voltage of the first electrode of the drive transistor DN is charged to Vdata, such that the drive transistor DN is enabled. The first threshold compensation sub-circuit and the second threshold compensation sub-circuit control, respectively in response to the fourth switch control signal P4 and the fifth switch control signal P5, to enable a circuit between the second electrode and the gate of the drive transistor DN, such that a voltage at the gate of the drive transistor DN is Vdata+Vth, wherein Vth represents a threshold voltage corresponding to the drive transistor DN. In this way, the voltage of the gate of the drive transistor DN is compensated for.

Figure 4:
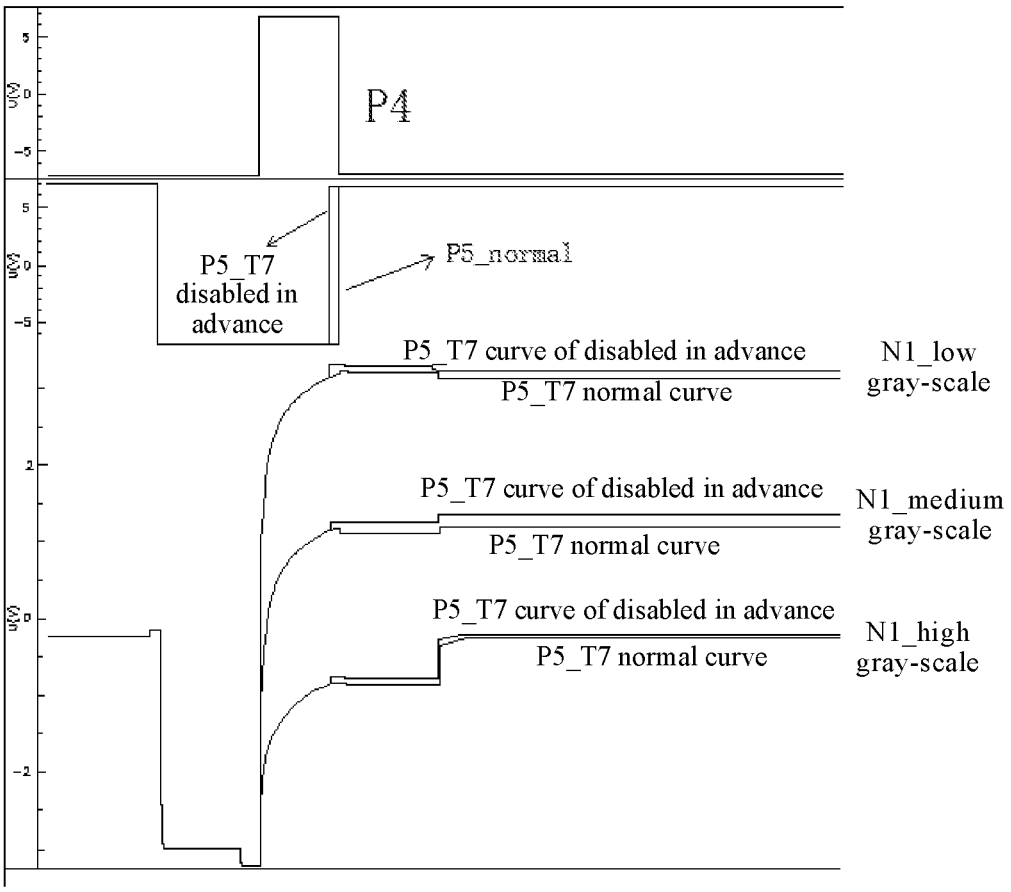
FIG. 4 illustrates contrast curves between a pixel circuit P5 disabled in advance and the pixel circuit P5 disabled normally according to an embodiment of the present disclosure.

As shown in FIG. 4, before the threshold compensation phase ends, the fifth switch control signal P5 controls the second threshold compensation sub-circuit to be disabled certain time ahead of the first threshold compensation sub-circuit, and controls the circuit between the gate and the second electrode of the drive transistor DN to be disabled within the preset time period.

To further increase the charge rate and ensure the compensation effect of the threshold voltage Vth when driving at a high frequency (120 Hz), a timing sequence of the fifth switch control signal P5 may be adjusted, such that the fifth switch control signal P5 jumps upwards in advance before the threshold compensation phase ends. In this way, it is ensured that the seventh transistor T7 is disabled in advance. In this embodiment of the present disclosure, an LTPS TFT is used as the seventh transistor T7. Before the threshold compensation phase ends, the parasitic capacitor Cgs drives the first node N1 to jump upwards when the gate voltage jumps upwards, such that the data range L0~L255 deviates to the direction of the voltage 0V as a whole. In the threshold compensation phase, the fourth switch control signal P4 jumps downwards such that the sixth transistor T6 is disabled. At this moment, since the seventh transistor T7 has been disabled, variation of the gate voltage of the sixth transistor T6 has no effect on the first node N1.

A method for driving a pixel circuit is applied to the aforementioned pixel driving circuit. The driving method includes a reset phase, a threshold compensation phase, and a light enable phase.

In the reset phase t1, the first initialization sub-circuit applies the reset voltage to the light-emitting element in response to the second switch control signal P2 to reset the first terminal of the light-emitting element. The second initialization sub-circuit controls on/off of the second initialization sub-circuit in response to the third switch control signal P3. The second threshold compensation sub-circuit controls on/off of the second threshold compensation sub-circuit in response to the fifth switch control signal P5, and applies the reset voltage to the gate of the drive transistor DN to reset the gate of the drive transistor DN.

In the threshold compensation phase t2, the data-in sub-circuit writes a data signal to the first electrode of the drive transistor DN in response to the first switch control signal P1, the data signal is inputted to a data voltage Vdata, and a voltage of the first electrode of the drive transistor DN is charged to Vdata, such that the drive transistor DN is enabled. The first threshold compensation sub-circuit and the second threshold compensation sub-circuit control, respectively in response to the fourth switch control signal P4 and the fifth switch control signal P5, to enable a circuit between the second electrode and the gate of the drive transistor DN, such that a voltage at the gate of the drive transistor DN is Vdata+Vth, wherein Vth represents a threshold voltage corresponding to the drive transistor DN. In this way, the voltage of the gate of the drive transistor DN is compensated for.

In the embodiments of the present application disclose, the first control line and the second control line are different signal lines, and the first switch control signal P1 and the second switch control signal P2 are different switch control signals.

In the light enable phase t3, the first light-emission control sub-circuit applies the voltage of the first power terminal to the first electrode of the drive transistor DN in response to the light emission signal EM, such that the drive transistor DN is enabled. The second light-emission control sub-circuit applies the drive current to the light-emitting element in response to the light emission signal EM to drive the light-emitting element to emit light.

When the pixel circuit is configured to drive a full black screen L0, the drive transistor DN is in the disabled state in the light enable phase. This is because a data signal L0 is written into the drive transistor DN in the threshold compensation phase. In the reset phase, the fourth node N4 is reset to Vinit (for example, −3V). In the light enable phase, due to current leakage of the drive transistor DN, the voltage of the fourth node N4 may be gradually pulled up. When a voltage difference between the fourth node N4 and VSS is greater than the threshold voltage of an OLED, the OLED emits light, which causes the brightness of L0 to increase, and a display contrast to deteriorate. This phenomenon is more obvious when driving at low frequencies.

Therefore, in this embodiment of the present disclosure, for the screen L0, in the light enable phase, a preset amount of active pulse signals are loaded to the second switch control signal P2, such that the first initialization sub-circuit is controlled to be enabled or disabled by means of the second switch control signal P2, to reset the first terminal of light-emitting element multiple times.

It is to be noted that in this embodiment of the present disclosure, an active signal (level) refers to a signal (level) for enabling a corresponding switching element, and an inactive signal (level) refers to a signal for disabling the corresponding switching element. Similarly, this explanation prevails in other embodiments of the present disclosure. The active level and the inactive level only represent that the level of this signal has two state quantities, but does not represent that the active level or the inactive level has a specific value throughout the specification.

In a specific embodiment, the light enable phase also includes a second preset amount of reset subphases and a light enable subphase after each of the reset subphases. In the light enable phase, the second switch control signal P2 and the light emission signal EM have the same pulse frequency.

In the reset subphases, as an N-type LTPO TFT, the fourth transistor T4 is enabled when the second switch control signal P2 is at the high level. As a P-type LTPO TFT, the second transistor T2 is disabled when the light emission signal EM is at the high level. The reset voltage is applied to the light-emitting element by means of the fourth transistor T4 to reset the first terminal of the light-emitting element.

In the light enable subphase, the light emission signal EM is at the low level, the first transistor T1 and the second transistor T2 are enabled at the low level, and the drive transistor DN is disabled under the control of write data L0 to display a black screen L0.

It is to be noted that the reset subphases mentioned in this embodiment and the reset phase are not the same phase. In the reset phase, the second initialization sub-circuit resets the gate of the drive transistor DN. However, in a reset subphase, only the first initialization sub-circuit resets the first terminal of the light-emitting element, and the second initialization sub-circuit does not reset the gate of the drive transistor DN.

It is also to be noted that the reset subphase is within the light enable phase when it is not the screen L0, the pixel circuit goes through one reset phase and one data-writing phase. However, in the light enable phase, the pixel circuit does not go through the data-writing phase or the threshold compensation phase any more.

Figure 5:
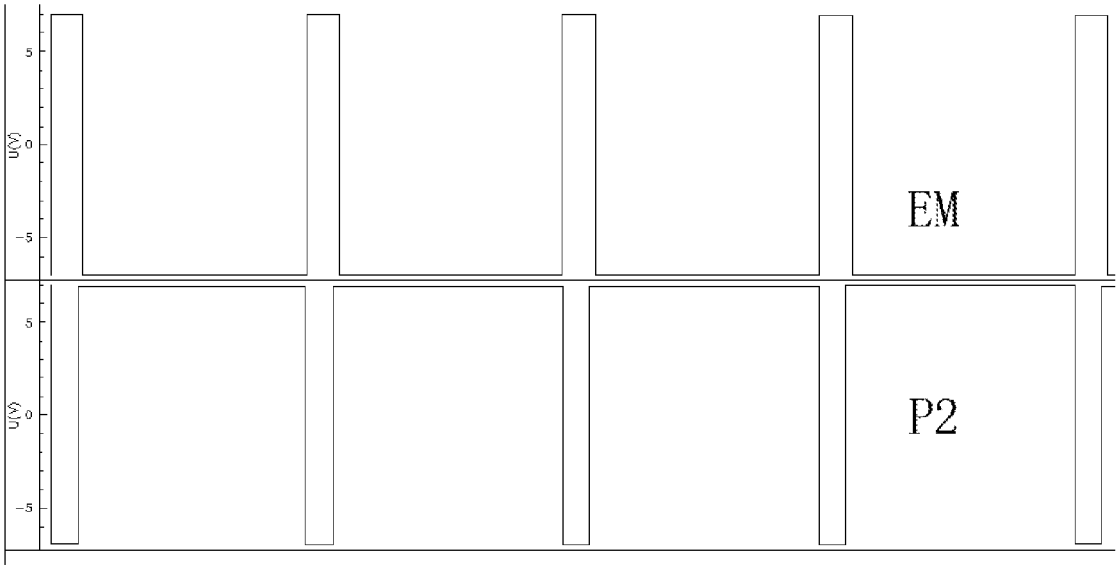
FIG. 5 is a timing diagram of a second switch control signal of a pixel circuit according to an embodiment of the present disclosure.

In this embodiment of the present disclosure, as shown in FIG. 5, by keeping the second switch control signal P2 consistent in frequency with the light emission signal EM, the first transistor T1 and the second transistor T2 are both disabled when the light emission signal EM is at the high level. At this moment, the second switch control signal P2 is at the low level, the fourth transistor T4 is enabled, and the reset voltage is applied to the first terminal of the light-emitting element to reset the fourth node N4 again. Frequencies of the second switch control signal P2 and the light emission signal EM are high frequencies. When the pixel circuit is driven at a low frequency, for example, when the pixel circuit is driven at 1 Hz, the switching frequency of the light emission signal EM remains at 240 Hz, and the second switch control signal P2 also remains at 240 Hz. In specific settings, time of the reset subphase may be set to be shorter than that of a light emission subphase.

In this embodiment of the present disclosure, the fourth node N4 is reset multiple times to ensure that the voltage of the fourth node N4 will not be pulled up due to current leakage of the drive transistor DN for a long time, such that the full black screen L0 can be guaranteed.

It is to be noted that in the embodiments of the present disclosure, other types of transistors and different switch control signals may be adopted when implementing the same on-off control. The above embodiments are merely exemplary embodiments employed to describe the principles of the present disclosure. However, the present disclosure is not limited thereto.

In a third aspect, the present disclosure provides a display panel, which includes the aforementioned pixel circuit. The display panel may be applied to any product or component having a display function, such as an OLED display device, an AMOLED display device, a mobile phone, a tablet personal computer, a TV set, a display, a notebook computer, a digital photo frame, a navigation device and so on.

It is to be understood that the orientations or positions represented by the terms of "length", "width", "up", "down", "front", "back", "left", "right", "vertical", "horizontal", "top", "bottom", "in", "out", and the like are based on the orientations or positions as shown in the accompanying drawings, they are merely for ease of a description of the present disclosure and a simplified description instead of being intended to indicate or imply the device or element to have a special orientation or to be configured and operated in a special orientation. Thus, they cannot be understood as limiting of the present disclosure.

In addition, terms "first" and "second" are used only for purposes of description and are not intended to indicate or imply relative importance or to imply the number of indicated technical features. Thus, the feature defined with "first" and "second" may explicitly or implicitly include at least one such feature. In the description of the present disclosure, "a plurality of" refers to at least two, unless otherwise expressly specified.

Unless otherwise defined, all technical and scientific terms used herein have the same meaning as commonly understood by one of ordinary skill in the art to which the present disclosure belongs. The terms used herein are merely for the purpose of describing particular embodiments and are not intended for limiting the present disclosure. Terms such as "arrangement" as used herein may mean that one component is directly attached to another component, or that one component is attached to another component through an intermediate component. A feature described herein in one embodiment may be applied to another embodiment, either alone or in combination with other features, unless the feature is not applicable or otherwise stated in the other embodiment.

The present disclosure has been described by the foregoing embodiments, but it is to be understood that the foregoing embodiments are merely for purposes of illustration and explanation, and are not intended to limit the present disclosure to the scope of the described embodiments. It will be appreciated by those skilled in the art that more variations and modifications can be made in accordance with the teachings of the present disclosure, and these variations and modifications fall within the protection claimed by the present disclosure.

What is claimed is:

1. A method for driving a pixel circuit, being applied to a pixel driving circuit, the pixel driving circuit comprising:

a light-emitting element;

a drive transistor, wherein the drive transistor is configured to generate a drive current on a conduction path from a first electrode of the drive transistor to a second electrode of the drive transistor in response to a signal from a gate of the drive transistor;

a first light-emission control sub-circuit, wherein the first light-emission control sub-circuit is connected to a first power terminal and the first electrode of the drive transistor, and is configured to apply a voltage of the first power terminal to the drive transistor in response to a light emission signal;

a second light-emission control sub-circuit, wherein the second light-emission control sub-circuit is connected to the second electrode of the drive transistor and a first terminal of the light-emitting element, and is configured to apply the drive current to the light-emitting element in response to the light emission signal, wherein a second terminal of the light-emitting element is connected to a second power terminal;

a data-in sub-circuit, wherein the data-in sub-circuit is configured to write a data signal into the first electrode of the drive transistor in response to a first switch control signal;

a first initialization sub-circuit, wherein the first initialization sub-circuit is connected to the first terminal of the light-emitting element and an initial voltage terminal, and is configured to apply a reset voltage to the light-emitting element in response to a second switch control signal;

a second initialization sub-circuit and a second threshold compensation sub-circuit, wherein the second initialization sub-circuit is connected to the second threshold compensation sub-circuit and the initial voltage terminal, and is configured to apply the reset voltage to the gate of the drive transistor in response to a third switch control signal;

a first threshold compensation sub-circuit, wherein the first threshold compensation sub-circuit is connected to the second electrode of the drive transistor and the second threshold compensation sub-circuit, and is configured to transmit a signal from the second electrode of the drive transistor to the second threshold compensation sub-circuit in response to a fourth switch control signal;

the second threshold compensation sub-circuit is connected to the first threshold compensation sub-circuit, the second initialization sub-circuit and the gate of the drive transistor, and is configured to transmit a signal from the first threshold compensation sub-circuit or a signal from the second initialization sub-circuit to the gate of the drive transistor in response to a fifth switch control signal; and a capacitor, wherein a first terminal of the capacitor is connected to the first power terminal, and a second terminal of the capacitor is connected to the gate of the drive transistor;

the driving method comprising a reset phase, a threshold compensation phase, and a light enable phase; wherein in the reset phase, the first initialization sub-circuit applies the reset voltage to the light-emitting element in response to the second switch control signal to reset the first terminal of the light-emitting element; the second initialization sub-circuit controls on/off of the second initialization sub-circuit in response to the third switch control signal, the second threshold compensation sub-circuit controls on/off of the second threshold compensation sub-circuit in response to the fifth switch control signal, and applies the reset voltage to the gate of the drive transistor to reset the gate of the drive transistor;

in the threshold compensation phase, the data-in sub-circuit writes the data signal to the first electrode of the drive transistor in response to the first switch control signal, the data signal includes a data voltage Vdata, and a voltage of the first electrode of the drive transistor is charged to the data voltage Vdata, such that the drive transistor is enabled; the first threshold compensation sub-circuit and the second threshold compensation sub-circuit control, respectively in response to the fourth switch control signal and the fifth switch control signal, to enable a circuit between the second electrode and the gate of the drive transistor, such that a voltage at the gate of the drive transistor is $Vdata_{+}Vth$, wherein Vth represents a threshold voltage corresponding to the drive transistor, to compensate for the voltage of the gate of the drive transistor; and in the light enable phase, the first light-emission control sub-circuit applies the voltage of the first power terminal to the first electrode of the drive transistor in response to the light emission signal, such that the drive transistor is enabled, and the second light-emission control sub-circuit applies the drive current to the light-emitting element in response to the light emission signal to drive the light-emitting element to emit light.

2. The method for driving a pixel circuit according to claim 1, wherein the method further comprises:

before the threshold compensation phase ends, the fifth switch control signal controls the second threshold compensation sub-circuit to be disabled a preset time ahead of the first threshold compensation sub-circuit, and controls the circuit between the gate and the second electrode of the drive transistor to be disabled within the preset time.

3. The method for driving a pixel circuit according to claim 1, wherein the method further comprises:

under the condition that the pixel circuit is configured to drive a full black screen, a preset amount of active pulse signals are loaded to the second switch control signal, such that the first initialization sub-circuit is controlled to be enabled or disabled by means of the second switch control signal, to reset the first terminal of light-emitting element multiple times.

4. The method for driving a pixel circuit according to claim 3, wherein the light enable phase further comprises a second preset amount of reset subphases and a light enable subphase after each of the reset subphases.

5. The method for driving a pixel circuit according to claim 4, wherein in the light enable phase, the second switch control signal and the light emission signal have a same pulse frequency.

6. The method for driving a pixel circuit according to claim 5, wherein the second light-emission control sub-circuit includes a second transistor, the first initialized sub-circuit includes a fourth transistor;

in the reset phase, the fourth transistor is an N-type low-temperature polycrystalline oxide thin film transistor, the second transistor is a P-type low-temperature polycrystalline oxide thin film transistor, a reset voltage is applied to the light-emitting element through the fourth transistor to reset the first end of the light-emitting element.

7. The method for driving a pixel circuit according to claim 5, wherein the first control line and the second control line are different signal lines, and the first switch control signal and the second switch control signal are different switch control signals.

* * * * *